US006103068A

United States Patent [19]

Merten et al.

[11] Patent Number: 6,103,068

[45] Date of Patent: Aug. 15, 2000

[54] PROCESS FOR ANTIFELTING FINISHING OF WOOL USING A LOW-TEMPERATURE PLASMA TREATMENT

[75] Inventors: Thomas Merten, Gifhorn; Helga Thomas, Herzogenrath; Hartwig Höcker, Aachen, all of Germany

[73] Assignee: Bayer Aktiengesellschaft, Leverkusen, Germany

[21] Appl. No.: 09/171,345

[22] PCT Filed: Apr. 14, 1997

[86] PCT No.: PCT/EP97/01859

§ 371 Date: Oct. 16, 1998

§ 102(e) Date: Oct. 16, 1998

[87] PCT Pub. No.: WO97/41293

PCT Pub. Date: Nov. 6, 1997

[30] Foreign Application Priority Data

Apr. 26, 1996 [DE] Germany ..... 196 16 776

[51] Int. Cl.[7] ..... B01J 19/08

[52] U.S. Cl. ..... 204/164; 204/165; 8/112; 8/128.1

[58] Field of Search ..... 204/164, 165; 8/112, 128.1

[56] References Cited

U.S. PATENT DOCUMENTS

| | | | |
|---|---|---|---|
| 3,746,858 | 7/1973 | Pavlath et al. | 317/4 |
| 3,870,610 | 3/1975 | Baird et al. | 204/165 |
| 5,160,592 | 11/1992 | Spitsin et al. | 204/164 |
| 5,344,462 | 9/1994 | Paskalov et al. | 8/115.52 |
| 5,407,446 | 4/1995 | Sando et al. | 8/103 |
| 5,435,156 | 7/1995 | Sando et al. | 68/5 D |
| 5,972,160 | 10/1999 | Straemke | 156/345 |

FOREIGN PATENT DOCUMENTS

| | | |
|---|---|---|
| 0 548 013 | 6/1993 | European Pat. Off. . |
| 4344428 | 6/1995 | Germany . |
| 63-303177 | 12/1988 | Japan . |
| 1-207472 | 8/1989 | Japan . |

OTHER PUBLICATIONS

A. E. Pavlath et al, "Effect of the Afterglow or the Felting Shrinkage of Wool" Textile Research Journal, 45 (month unavailable) 1975, p. 742.

W. Rakowski, Melliand Textilber. 10 (month unavailable) 1989, pp. 780–785.

Database, Sec. CH, Wk 9513, AN 95–097118 and RU 2016156, Jul. 15, 1994.

Textile Research Journal, vol. 38, Jun. 1968, pp. 644–658.

John R. Hollanhan, Alexis T. Bell: "Techniques and Applications of Plasma Chemistry, Tech. Applications" 1974, Attila E. Pavlath, "Plasma Treatment of Natural Materials", pp. 149–175.

*Primary Examiner*—Kishor Mayekar

*Attorney, Agent, or Firm*—Joseph C. Gil; Lyndanne M. Whalen

[57] ABSTRACT

A process for antifelt finishing of wool material composed of especially animal hairs by means of a low temperature plasma treatment, characterized in that moist wool material having a water content of 4 to 40% by weight is exposed, prior to further processing into textile fabrics or webs, to a high frequency discharge having a frequency of 1 kHz to 3 GHz and a discharge power density of 0.001 to 3 W/cm$^3$ at a pressure of $10^{-2}$ to 10 mbar for a period of 1 to 600 sec in the presence or absence of non-polymerized gases.

16 Claims, No Drawings

PROCESS FOR ANTIFELTING FINISHING OF WOOL USING A LOW-TEMPERATURE PLASMA TREATMENT

FIELD OF THE INVENTION

The present invention relates to a process for antifelt finishing of animal fibres that are prone to felting, especially wool, by subjecting the fibres to a low temperature plasma treatment.

BACKGROUND OF THE INVENTION

The principles of gas discharge and of plasma chemistry are known and described for example in A. T. Bell "Fundamentals of Plasma Chemistry" ed. J. R. Hollahan and A. T. Bell, Wiley, N.Y. (1974).

Processes for the plasma treatment of wool are likewise known per se and described for example in the papers by A. E. Pavlath et al., Text. Res. J. 45(1975) p. 742, and W. Rakowski, Melliand Textilber. 10(1989) p. 780.

German Offenlegungsschrift DE-41-17-332-A1 describes a process for the plasma treatment of moving textile webs wherein, inter alia, dried wool fabrics are subjected to a direct current discharge in air at about 80 to 90 Pa.

German Offenlegungsschrift DE-43-39-427-A1 likewise describes a plasma treatment process for fabric webs, but it is additionally supplemented by a downstream ozone treatment. This process is used for cleaning and desizing a cloth so as to replace traditional liquid pretreatments of textile webs. Both processes concern the treatment of already woven or knitted fabrics or of other webs of material. The references do not concern the pretreatment of unspun fibres or raw wool.

Processes are also known for a low temperature plasma or corona discharge treatment of wool to improve the dyeing of the wool. For instance, European Offenlegungsschrift EP-0 548 013 A1 describes a process for dyeing wool level in the fibre and the piece by subjecting the dried wool to a low temperature plasma or corona discharge with a non-polymerizable gas and then dyeing it from an aqueous liquor free of levelling agent.

It has now been found that the plasma treatment does in practice bring about a certain improvement in dyeability. However, the textile processing industry is particularly interested in a reduction in the felting tendency of wool, especially of raw, or unprocessed, wool.

The felting of wool is customarily reduced by finishing the wool with applied auxiliaries.

However, processes are also known for the antifelt finishing of wool by means of a combination of plasma pretreatment and enzymatic aftertreatment. Such a process is described for example in German Offenlegungsschrift DE-43 44 428 A1.

The existing processes cited are ineffective or unsatisfactory with regard to the antifelt finishing of wool.

In addition, plasma treatment processes are handicapped by the presence of water, present in most wools up to a maximum proportion of 33% by weight or even up to 40% by weight in the case of alkali treatment.

The varying moisture content of the fibre is considered a disadvantage for these processes because the production throughput fluctuates as a result. For this reason, in the processes, the wool material is dried prior to the plasma treatment at the cost of additional complication and expense.

Plasma treatment in the presence of small amounts of water is otherwise only known from U.S. Pat. No. 5,344,462.

SUMMARY OF THE INVENTION

However, this reference is concerned not with the antifelt finishing of raw wool, but with improving the dyeability or impregnation of paper webs, plastics films or textile materials having a very different composition. The effect of the plasma described in U.S. Pat. No. 5,344,462 on raw wool is not known.

It is an object of the present invention to provide wool, especially in the form of combed sliver, with an antifelting finish, so that it will not felt and shrink in the washing machine after further processing into made-up material.

DETAILED DESCRIPTION OF THE INVENTION

This object is achieved according to the invention by a process for antifelt finishing of wool material composed of especially animal hairs by means of a low temperature plasma treatment, characterized in that moist wool material having a water content of 4 to 40% by weight is exposed, prior to further processing into textile fabrics or webs, to a high frequency discharge having a frequency of 1 kHz to 3 GHz and a discharge power density of 0.001 to 3 W/cm$^3$ at a pressure of $10^{-2}$ to 10 mbar for a period of 1 to 600 sec in the presence or absence of non-polymerizing gases.

The wool material used is raw wool following the raw wool scour, combed sliver or wool yam, preferably raw wool or combed sliver.

The wool material used in the preferred process has a water content of 5 to 30% by weight, preferably 8 to 25% by weight.

The plasma treatment is carried out in a preferred variant at a pressure of $10^{-1}$ to 1 mbar and especially for a period of 2 to 5 minutes. The plasma treatment in a microwave discharge of 1 to 3 GHz is preferred.

The plasma treatment is carried out in a particular embodiment in a pulsed high frequency discharge, the pulsing frequency being up to 10 kHz.

If non-polymerizing gases are additionally used as plasma process gases, they are introduced into the plasma treatment room at a flow rate of up to 200 l/h.

Particulary suitable gases are oxygen, nitrogen, noble gases, especially argon, or air or mixtures thereof.

The design and construction of a low temperature plasma reactor are known per se. Preference is given to using an electrodeless reactor having an outcoupling for microwaves. The wool material to be treated is preferably placed underneath the outcoupling unit. The distance of the wool material from the outcoupling unit preferably is 1–30 cm, especially 2–10 cm. After the material to be treated has been introduced into the reactor at a constant moisture content (of material to be treated) of 4–40% by weight, the reactor is suitably evacuated with vacuum pumps in such a way that the pressure during the plasma treatment is between $10^{-2}$ to 10 mbar, preferably at $10^{-1}$ to 1 mbar.

A continuous flow-through operation is enabled by applying in particular specific vacuum locks which make it possible for the material to enter and exit without leakage. The actual low temperature plasma is generated by feeding in electromagnetic radiation within the frequency range from 1 kHz to 3 GHz, preferably microwaves of the frequency 1–3 GHz. (The power density at the outcoupling is especially 0.1 to 15 W/cm$^2$.) The electromagnetic radiation can be supplied to the recipient continuously or pulsed, in which case a pulsing frequency of up to 10 kHz is used.

The particular effect of the plasma treatment of the invention might be explained as follows: The liquid present in the fibre desorbs off the fibre surface as water vapour/gas during the process. A glow discharge develops in the reactor through incoupling of the electromagnetic radiation. High energy electrons, ions and also highly excited neutral molecules or radicals are formed and act on the surface of the fibre, the water vapour being desorbed off the fibre causing particularly reactive particles to be formed in the immediate vicinity of the respective fibre surface and to act on the surface.

Preference is given to using a treatment time of 1 to 600 s.

In addition, a further reaction gas can be passed through the reactor as described, so that in this case a gas mixture results of added and fibre-desorbed gas/vapour.

The advantages of the invention are that the antifelting effect obtained on the wool material by this process is significantly better than in the case of material which has been dried prior to the plasma treatment. In addition, the process saves energy, since there is no need for any predrying of the material, as required in the prior art before the plasma treatment. As well as reducing the felting effect, the plasma treatment of the invention affords a further improvement in the dyeing with regard to levelness, bath exhaustion and amount of dye used, which is higher than in the case of predried material. The process thus offers economic as well as ecological advantages.

In general, the process described can be used to produce an antifelting finish on all natural protein fibres (wool fibres) which tend to felt because of their surface structure.

Generally, the operation of industrial vacuum systems is very difficult because of moisture or substances which desorb moisture or water vapour, since water counteracts any reductions in pressure and contributes to pump system corrosion and wear. To counteract this problem in the case of wool as substrate, a predrying of the wool material to be treated is the rule in the prior art. Surprisingly, however, it is the moisture content of the fibre which, in the process of the invention, plays a crucial part in determining the magnitude of the antifelting effect obtainable using the plasma treatment, so that any drying of the wool prior to a low temperature plasma treatment is deliberately dispensed with and the wool which is to be given an antifelting finish has a defined moisture content when it is subjected to a plasma treatment.

The invention described herein is especially useful for the antifelt finishing of wool fibres of any fineness. The properties of the wool material with regard to felting tendency and/or dyeability can, if desired, be additionally augmented after the plasma treatment by treating the wool material with resins and other antifelting finishes or dyeing auxiliaries.

EXAMPLES

Example 1

Wool combed sliver having a fineness of 21 $\mu$m is subjected to a low temperature plasma treatment. The treatment has for its purpose to reduce the felting tendency of the wool combed sliver. The treatment is carried out according to two variants:

According to the process of the invention by the use of wool combed sliver which has been conditioned in the standard atmosphere (20° C., 65% relative humidity) prior to the treatment and has a moisture content of 15% by weight;

by the use of a wool combed sliver dried in a through-circulation drying cabinet at 50° C., for 2 hours prior to the treatment and has a moisture content of 3% by weight.

The plasma treatment is carried out under the following conditions, which are the same for the two variants:

Frequency: 2.45 GHz
Power: 300 W
The power density per unit area was 0.78 W/cm$^2$ at the outcoupling unit.
The power density per unit volume was 0.022 W/cm$^3$.
Pressure: 0.1 mbar
Gas: oxygen
Flow rate: 19.8 ml/min
Distance from outcoupling: 14.2 cm
Treatment duration: 300 s The felting behaviour was determined using the IWTO standard IWTO-20-69. The process carried out according to the invention (on material having a moisture content of 15% by weight) reduces the felting tendency by 63% compared with the same material without plasma treatment. In the case of the material treated according to the second variant, the felting tendency is only 49% reduced compared with a material without plasma treatment.

Example 2

Wool combed sliver having a fineness of 21 $\mu$m is subjected to a low temperature plasma treatment. The treatment has for its purpose to reduce the felting tendency of the wool combed sliver. The plasma treatment is carried out following different residence times of the wool in a vacuum prior to the actual plasma treatment. This reduces the moisture content of the wool prior to the actual plasma treatment. The conditions of the plasma treatment are as follows:

Variant 1: Low temperature plasma treatment of combed sliver: ignition of
plasma at a water content of 7% by weight
Frequency: 2.45 GHz
Power: 300 W
The power density per unit area was 0.87 W/cm$^2$ at the outcoupling unit.
The power density per unit volume was 0.022 W/cm$^3$.
Pressure: 0.1 mbar
No additional gas
Distance from outcoupling: 14.2 cm
Treatment duration: 300 s Variant 2: Low temperature plasma treatment of combed sliver: ignition of
plasma at a water content of 6% by weight
Frequency: 2.45 GHz
Power: 300 W (power density per unit area at the outcoupling unit: 0.87 W/cm$^2$)
The power density per unit volume was 0.022 W/cm$^3$.
Pressure: 0.1 mbar
Gas: oxygen
Flow rate: 19.8 ml/min
Distance from outcoupling: 14.2 cm
Treatment duration: 300 s Variant 3: Low temperature plasma treatment of combed sliver: ignition of
plasma at a water content of 1% by weight
Frequency: 2.45 GHz
Power: 300 W (power density per unit area at the outcoupling unit: 0.87 W/cm$^2$)
The power density per unit volume was 0.022 W/cm$^3$.
Pressure: 0.1 mbar
Gas: oxygen
Flow rate: 19.8 ml/min
Distance from outcoupling: 14.2 cm
Treatment duration: 300 s The felting behaviour is determined as under Example 1.

Variant 1 reduces the felting tendency by 69% compared with the untreated material.

Variant2 reduces the felting tendency by 65% and variant 3 by merely 56%.

What is claimed is:

1. A process for antifelt finishing of wool material composed especially of animal hairs by means of a low temperature plasma treatment comprising exposing moist wool material having a water content of 4 to 40% by weight, prior to further processing into textile fabrics or webs, to a low temperature plasma treatment of a high frequency discharge having a frequency of 1 kHz to 3 GHz and a discharge power density of 0.001 to 3 $W/cm^3$ at a pressure of $10^{-2}$ to 10 mbar for a period of 1 to 600 sec.

2. The process of claim 1 in which the wool material used is raw wool following the raw wool scour, combed sliver or wool yarn.

3. The process of claim 1 in which the wool material used has a water content of 5 to 30% by weight.

4. The process of claim 1 in which the plasma treatment is carried out at a pressure of $10^{-1}$ to 10 mbar.

5. The process of claim 1 in which the plasma treatment is carried out for a period of 2 to 5 minutes.

6. The process of claim 1 in which the plasma treatment is carried out with a discharge power density of 0.01 to 1 watt.

7. The process of claim 1 in which the plasma treatment is carried out in a microwave discharge of 1 to 3 GHz.

8. The process of claim 1 in which the plasma treatment is carried out in a pulsed high frequency discharge, the pulsing frequency being up to 10 kHz.

9. The process of claim 1 in which the distance of the wool material from the outcoupling unit generating the discharge is 1 to 30 cm.

10. The process of claim 1 in which non-polymerizing gases are introduced into a plasma treatment area at a flow rate of up to 200 l/h and are selected from the consisting of air, oxygen, nitrogen, and noble gases.

11. The process of claim 1 in which the wool material used is raw wool or combed silver.

12. The process of claim 1 in which the wool material has a water content of from 8 to 25% by weight.

13. The process of claim 1 in which the distance of the wool material from the outcoupling unit generating the discharge is from 2 to 20 cm.

14. The process of claim 1 in which a non-polymerizing gas is introduced into a plasma treatment room.

15. The process of claim 14 in which the non-polymerizing gas is introduced into a plasma treatment area at a flow rate of up to 200 l/h.

16. The process of claim 15 in which the non-polymerizing gas is argon or air.

* * * * *